United States Patent [19]

Narita et al.

[11] Patent Number: 4,671,668

[45] Date of Patent: Jun. 9, 1987

[54] TIMING METHOD AND APPARATUS

[75] Inventors: Ryuuho Narita; Masahiro Imai, both of Nagoya, Japan

[73] Assignee: Kabushiki Kaisha Toshiba, Kawasaki, Japan

[21] Appl. No.: 773,259

[22] Filed: Sep. 6, 1985

[30] Foreign Application Priority Data

Sep. 14, 1984 [JP] Japan ..... 59-193082

[51] Int. Cl.[4] ..... G04B 37/00; G04G 15/00

[52] U.S. Cl. ..... 368/10; 99/286; 99/327; 368/9

[58] Field of Search ..... 99/468, 327, 335; 368/186, 10, 9, 89, 107–109, 113

[56] References Cited

U.S. PATENT DOCUMENTS 4,196,582 4/1980 Hersberger et al. .
4,379,339 4/1983 Narita .
4,406,217 9/1983 Oota ..... 99/286

FOREIGN PATENT DOCUMENTS 0055144 9/1985 European Pat. Off. .
2156831 of 1973 France .
2397670 2/1979 France .

OTHER PUBLICATIONS

Owner's Guidebook, Toshiba Mill & Drip HCD-850.

*Primary Examiner*—Bernard Roskoski
*Attorney, Agent, or Firm*—Cushman, Darby & Cushman

[57] ABSTRACT

A timer device, which has at least a load control function, includes a counter, circuitry for setting the counter, a display and a controller. Generally, the display displays a value of the counter. The controller causes the display to flash while the load is being operated, but keeps the display continuous when the setting circuitry is operated even if the load is being operated. This aids in the setting process.

9 Claims, 4 Drawing Figures

TIMING METHOD AND APPARATUS

BACKGROUND OF THE INVENTION

1. Field of the Invention

The present invention relates to a timer device, having at least a load control function, including a counter whose counting value is set by a setting means.

2. Description of the Prior Art

Timers have been well known for automatically controlling a coffee maker with a mill mechanism for milling coffee beans contained in a case into coffee powder and a drip mechanism for pouring hot water to the coffee powder to extract coffee. The timer devices include a clock counter for providing time of day information, a load control counter for counting a desired milling time and a display means for usually indicating the time of day as controlled by the clock counter. The display means also indicates, with a flashing display, the remaining time for milling as controlled by the load control counter during each milling operation, and also with a flashing display, the time of day as controlled by the clock counter during each dripping operation. As a result, it is possible to tell whether the coffee maker is milling or dripping.

The conventional timer device was so constructed that the set value for the time of day and desired milling time could be altered, but the setting operation was difficult in certain circumstances. During a drip operation, time of day flashes, and therefore changes of the time of day in the clock counter, during a dripping operation, would be attempted while the time of day was flashing. Similarly, any changes to the desired milling time, attempted during a milling operation, would occur while the display was flashing. In particular, if the flashing interval was long (so that the display would be off, periodically, for an extended period) and the setting means changed the set values at a rapid rate, the set value might be incremented several times during the interval in which the display means was off, making it difficult to set the desired value accurately.

SUMMARY OF THE INVENTION

Accordingly, an object of the present invention is to provide a timing method and timer device for apparatus enabling users to set a desired value accurately and easily in a counter during a predetermined operation of the apparatus. According to the present invention, a control circuit controls a display of a display means during an operation of the apparatus. The control circuit changes the display of the display means from flashing to continuously on when a setting means for setting a desired value to a counter is operated during an operation of the apparatus.

BRIEF DESCRIPTION OF THE DRAWINGS

These and other objects and advantages of this invention will become more apparent and more readily appreciated from the following detailed description of the presently preferred exemplary embodiment of the invention, taken in conjunction with the accompanying drawings, of which.

DETAILED DESCRIPTION OF THE PRESENTLY PREFERRED EXEMPLARY EMBODIMENT

An embodiment of the present invention applied to a coffee maker will be described in more detail with reference to the accompanying drawings.

Figure 1:
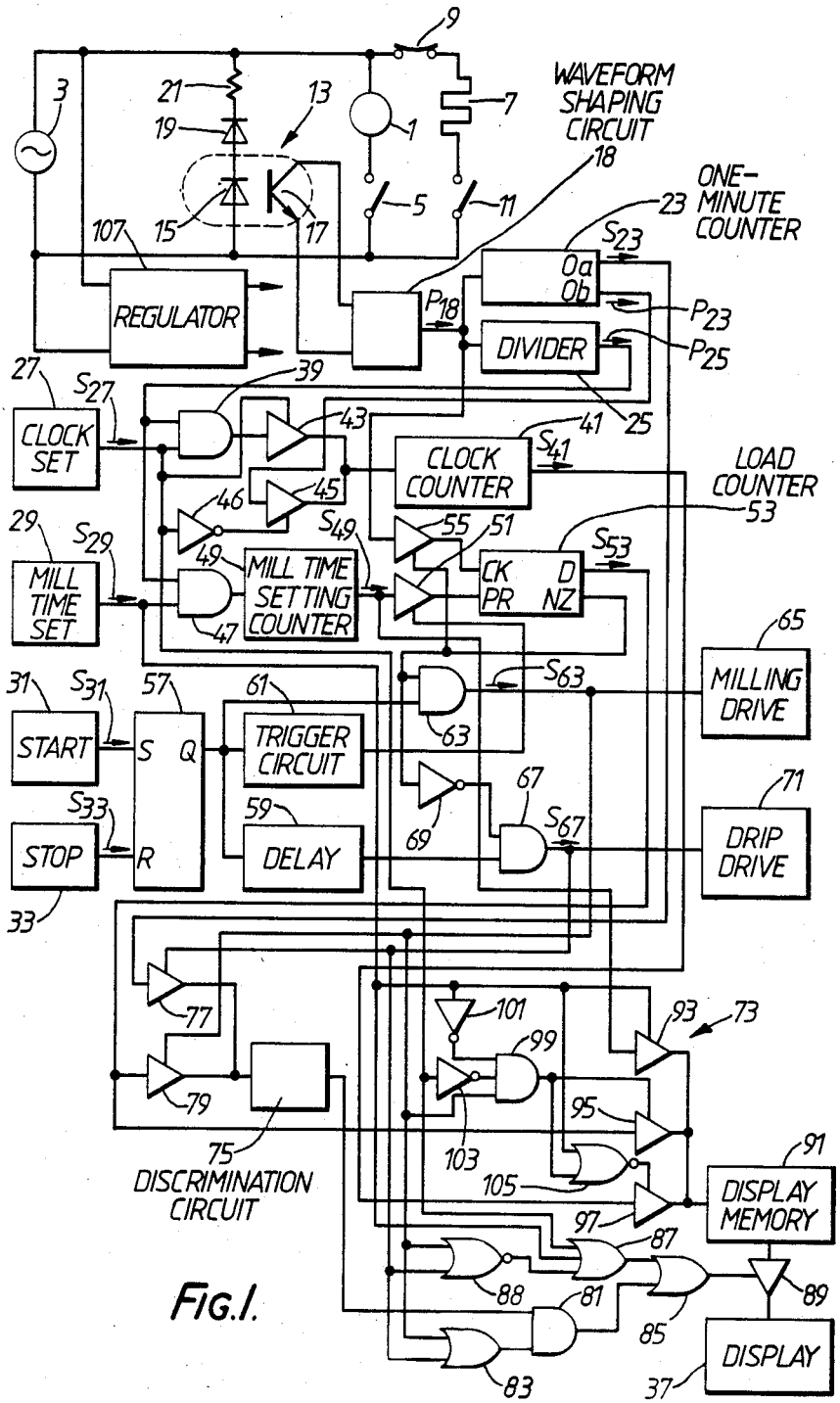
FIG. 1 shows a block diagram of an embodiment of this invention applied to a coffee maker.

Referring to FIG. 1, there is shown a block diagram of an embodiment. A coffee mill motor 1 is connected to an AC power source 3 through a first switch 5 (normally open type). Coffee mill motor 1, serving as a load, drives a cutter (not shown) for milling coffee beans in a milling case.

A heater 7 for boiling water has one end connected to coffee mill motor 1 through a thermal switch 9 and another end connected to power source 3 through a second switch 11 (normally open type). The water boiled by heater 7 is fed to the mill case.

Figure 2:
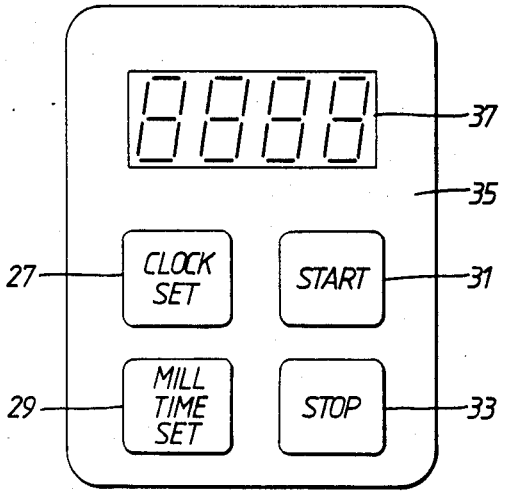
FIG. 2 shows a front view of an operating panel.

A timer device controlling the above-described circuit will be described with reference to FIGS. 1–4. A clock pulse generating circuit 13 includes a light emitting diode 15, a photo-transistor 17 and a waveform shaping circuit 18. The cathode of light emitting diode 15 is directly connected to AC power source 3 through an ordinary diode 19 and a resistor 21. The anode of diode 15 is directly connected to power source 3. The collector and emitter of photo-transistor 17 are connected to the input of waveform shaping circuit 18. Thus, the waveform shaping circuit 18 produces 60 clock pulses $P_{18}$ per second from its output when the power source is 100 V, 60 Hz single phase AC. The input of a one-minute counter 23 is connected to the output of waveform shaping circuit 18. When one-minute counter 23 receives clock pulses $P_{18}$ from clock pulse generating circuit 13, it divides clock pulses $P_{18}$ in frequency, performing a repetitive count operation in which 60 seconds of pulses are divided into 1/10 second intervals. Then one-minute counter 23 outputs a count signal $S_{23}$ from one of its outputs $O_a$ having one pulse every second on one line and one pulse every 1/10 second on another line. One-minute counter 23 also produces one-minute pulse $P_{23}$ from the other of its outputs $O_b$ once per minute. A frequency dividing circuit 25, whose input is connected to the output of waveform shaping circuit 18, divides the frequency of clock pulses $p_{18}$ so as to output one-second pulse $P_{25}$ every second. A clock-setting key (setting means) 27, a milling-time-setting key (setting means) 29, a start key 31 and a stop key 33 are provided on a control panel 35 as shown in FIG. 2. Depressing clock-setting key 27 produces a high level clock-setting signal $S_{27}$. Depressing milling-time-setting key 29 produces a high level milling-time-setting signal $S_{29}$. Depressing start key 31 produces a high level start signal $S_{31}$. Depressing stop key 33 produces a high level stop signal $S_{33}$. A display unit 37 mounted on control panel 35 is a four-figure segment-type display.

The output of clock-setting key 27 is connected to one of the inputs of an AND circuit 39. The other input of AND circuit 39 is connected to the output of frequency dividing circuit 25. The output of AND circuit 39 is connected to the input of a clock counter 41 through a transfer gate circuit 43. The input of clock counter 41 is also connected to the one pulse per minute output $O_b$ of one-minute counter 23 through a transfer gate circuit 45. Clock counter 41, counting hours and minutes, outputs its counter signal $S_{41}$. The gate of transfer gate circuit 43 is connected to the output of clock-setting key 27. The gate of transfer gate circuit 45 is connected to the output of clock-setting key 27 through an inverter circuit 46.

One of the inputs of an AND circuit 47 is connected to the output of the milling-time-setting key 29, the other input of which is connected to the output of frequency dividing circuit 25. The output of AND gate 47 is connected to the input of a milling-time-setting counter 49. The output of milling-time-setting counter 49 is connected through a transfer gate circuit 51 to the pre-set input PR of a load counter 53 consisting of a down-counter. Load counter 53 includes a clock input CK, output D and not-zero output NZ. The not-zero output NZ becomes low when the counting value of load counter 53 is 0 and is high level when the counting value is other than 0. The clock input CK of load counter 53 is connected to the output of waveform shaping circuit 18 through a transfer gate circuit 55, and the not-zero output NZ is connected to the gate of transfer gate circuit 55. In this case, the load counter 53 includes a frequency dividing circuit which divides the frequency of clock pulses $P_{18}$ which are supplied from waveform shaping circuit 18 to the clock input CK through transfer gate circuit 55, thereby decrementing the count in load counter 53 once every second.

The output of start key 31 is connected to the set-input S of an RS flip-flop circuit 57. The output of stop key 33 is connected to the reset-input R of flip-flop circuit 57. The Q output of flip-flop circuit 57 is connected to the input of a delay circuit 59 having a delay time of about 100 msec. The set-output Q is further connected to the input of a trigger circuit 61 and one of the inputs of an AND circuit 63. The other input of AND circuit 63 is connected to the not-zero output NZ of load counter 53, the output of which is connected to a milling drive circuit 65. The milling drive circuit 65 is so constructed that the first switch 5 is closed while a high level milling drive signal $S_{63}$ is supplied from AND circuit 63 thereto. The output of trigger circuit 61 is connected to the gate of transfer gate 51. The output of delay circuit 59 is connected to one of the inputs of AND circuit 67. The other input of AND circuit 67 is connected to not-zero output NZ of load counter 53 through inverter circuit 69. The output of AND circuit 67 is connected to a drip drive circuit 71. Drip drive circuit 71 is so constructed that second switch 11 is closed while a high level drip drive signal $S_{67}$ is supplied from AND circuit 67 thereto.

The construction of a control circuit 73 for controlling display unit 37 is described as follows. The input of a discrimination circuit 75 is connected to the output $O_a$ of one-minute counter 23 through a transfer gate circuit 77, and is connected to the output D of load counter 53 through a transfer gate circuit 79. The gate of transfer gate circuit 77 is connected to the output of AND circuit 67. The gate of transfer gate 79 is connected to the output of AND circuit 63. Discrimination circuit 75 is so constructed that it outputs a high level signal when the value of the 1/10 second unit of the count signal from load counter 53 (described below) or one-minute counter 23 is 0, 1, 2, 3 and 4, and outputs a low level signal when the value is 5, 6, 7, 8 and 9.

The output of discrimination circuit 75 is connected to one of the inputs of an AND circuit 81. The other input of AND circuit 81 is connected to the output of an OR circuit 83. One of the inputs of OR circuit 83 is connected to the output of AND circuit 63, and the other is connected to the output of AND circuit 67. Further, the output of AND circuit 81 is connected to one of the inputs of an OR circuit 85, the other input of which is connected to the output of changeover means such as an OR circuit 87.

In OR circuit 87, a first input is connected to the output of clock-setting key 27, a second input is connected to the output of milling-time-setting key 29, and a third input is connected to the output of a NOR circuit 88. One of the inputs of NOR circuit 87 is connected to the output of AND circuit 63, and the other input is connected to the output of AND circuit 67.

The output of OR circuit 85 is connected to the gate of a transfer gate circuit 89, the input of which is connected to the output of a display memory 91, the output of which is connected to the input of display unit 37. Further, the output of milling-time-setting counter 49, output D of load counter 53 and the output of clock counter 41 are connected to the input of display memory 91 through a transfer gate circuit 93, 95 and 97, respectively. The gate of transfer gate circuit 93 is connected to the output of milling-time-setting key 29. The gate of the transfer gate circuit 95 is connected to the output of an AND circuit 99. AND circuit 99 has a first input connected to the output of milling-time-setting key 29 through an inverter circuit 101, a second input connected to the output of clock-setting key 27 through an inverter circuit 103, and a third input connected to the output of AND circuit 63. In addition, the gate of transfer circuit 97 is connected to the output of a NOR circuit 105, one of the inputs of which is connected to the output of milling-time-setting key 29, the other input of which is connected to the output of AND circuit 99.

A DC constant-voltage power circuit 107 connected to power source 3 drops the voltage of AC power source 3 into a prescribed voltage, then rectifies and stabilizes the prescribed voltage to supply the individual circuits with the prescribed voltage as DC constant-voltage.

The operation of the above-disclosed embodiment will now be described.

Figure 3:
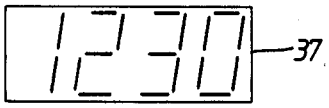
FIGS. 3 and 4 show respective front views showing different display states of a display means.

First of all, when the clock-setting key 27 is pressed, the high level clock-setting signal $S_{27}$ output from the key 27 is supplied to one of the inputs of AND circuit 39 and to the gate of transfer gate circuit 43 simultaneously. Consequently, one-second pulses $P_{25}$ from the frequency dividing circuit 25 are supplied to clock counter 41 through AND circuit 39 and transfer gate circuit 43. Thus, the value of a clock counter 41 is changed every second, every time a one-second pulse $P_{25}$ is supplied to clock counter 41. At this point, a high level milling-time-setting signal $S_{29}$ is not produced from the milling-time-setting key 29. Since the output signal from AND circuit 99 is a low level, NOR circuit 105 outputs a high level signal, which is supplied to the gate of transfer gate circuit 97. The count signal $S_{41}$ from clock counter 41 is therefore supplied to the input of the display memory 91 through the transfer gate circuit 97. Furthermore, the output signals of AND circuits 63 and 67 are low levels, so NOR circuit 88 produces a high level signal, which is supplied to the gate of transfer gate circuit 89 through OR circuits 87 and 85. The display unit 37 therefore displays the content of the display memory 91, that is, the count value of clock counter 41. If clock-setting key 27 is released when the display has reached the current time, e.g., "1230" (12:30), as shown in FIG. 3, the output signal of inverter circuit 46 will become a high level, thus the one-minute pulse $P_{23}$ from the output $O_b$ of one-minute counter 23 is supplied to the input of clock counter 41 through transfer gate circuit 45. The count value of clock counter 41 therefore changes every time a one-minute pulse $P_{23}$ is supplied, i.e., every minute, and the display of display means 37 shows the current time, such as "1231" (12:31), "1232" (12:32), . . .

When making coffee, a certain amount of the coffee beans corresponding to the desired amount of coffee is provided to the milling container, and a quantity of water corresponding to the amount of coffee beans is supplied to the water tank. When milling-time-setting key 29 is operated, milling-time-setting key 29 produces a high level milling-time-setting signal $S_{29}$, which is supplied to one of the inputs of AND circuit 47. Consequently, one-second pulses $P_{25}$ from the frequency dividing circuit 25 are supplied to the input of milling-time-setting counter 49 through AND circuit 47, causing milling-time-setting counter 49 to increment by one every second when a one-second pulse $P_{25}$ is supplied. The high level milling-time-setting signal $S_{29}$ is also provided to one of the inputs of NOR circuit 105. Consequently, it causes the output of NOR circuit 105 to become a low level. As a result of that, transfer gate circuit 97 is off, preventing display memory 91 from receiving the count-signal $S_{41}$ of clock counter 41.

Figure 4:
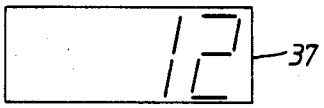

When a high level milling-time-setting signal $S_{29}$ is provided to the gate of transfer gate circuit 93, the count-signal $S_{49}$ of milling-time-setting counter 49 is provided to display memory 91 through transfer gate circuit 93. Thus, display unit 37 indicates the time set for milling. If milling-time-setting key 29 is released when display unit 37 is indicating the optimum milling time (for example, 12 seconds as shown in FIG. 4), milling-time-setting signal $S_{29}$ then ceases and the counting operation of milling-time-setting counter 49 stops, so that the count value is 12. It should be noted that when milling-time-setting key 29 is released, display means 37 again indicates the current time, because when milling-time-setting signal $S_{29}$ ceases, transfer gate circuit 93 is in the OFF state, and transfer gate circuit 97 is in the ON state.

After that, if start key 31 is pressed for a short time, high level start signal $S_{31}$ is produced by start key 31. Flip-flop circuit 57 then assumes a set state in response to the rise of start signal $S_{31}$, so that its Q output changes from a low level to high level. Trigger circuit 61 is then triggered in response to the rise of the output signal of the output Q to output a trigger pulse which is sent to the gate of transfer gate circuit 51. The count signal $S_{49}$ of milling-time-setting counter 49 is supplied to the pre-set input PR of load counter 53 through transfer gate circuit 51 so that the count signal $S_{49}$ indicating the counting value 12, for example, is pre-set in load counter 53. Subsequently, the output signal of the not-zero output NZ of load counter 53 is inverted into high level, both inputs of AND circuit 63 become high to output a high level milling drive signal $S_{63}$. The high level milling drive signal $S_{63}$ is supplied to milling drive circuit 65, which permits first switch 5 to close, thereby energizing coffee mill motor 1 to rotate the cutter for milling the beans. Since the high level output slgnal of the not-zero output NZ of load counter 53 is also supplied to the gate of transfer gate circuit 55, clock pulses $P_{18}$ from waveform shaping circuit 18 are supplied to the clock input CK of load counter 53 through transfer gate circuit 55, to decrement load counter 53 once per second. Furthermore, the high level milling drive signal $S_{63}$ from AND circuit 63 is supplied to the third input of AND circuit 99. At this time, the first input of AND circuit 99 is provided with a high level signal from inverter circult 101 since milling-time-setting signal $S_{29}$ is not being produced, and its second input is also high due to inverter circuit 103, since clock-setting signal $S_{27}$ is not being produced. Therefore, AND circuit 99 produces a high level signal and feeds it to the gate of transfer gate circuit 95. Count signal $S_{53}$ of load counter 53 is thereby supplied to the input of display memory 91 through transfer gate circuit 95. Since the high level milling drive signal $S_{63}$ of AND circuit 63 is also supplied to the gate of transfer gate circuit 79, count signal $S_{53}$ of load counter 53 is supplied to the discrimination circuit 75 through transfer gate circuit 79. Thus when the 1/10 second units of the count value indicated by the count signal $S_{53}$ is 0 to 4, the output signal of discrimination circuit 75 is a high level, and when it is 5 to 9, the output signal is a low level. Consequently in this case the output signal of the discrimination circuit 75 is high level during the latter 0.5 second of each of the count values from load counter 53 such as, i.e., 12, 11, 10, . . . , 0 indicated by the count signal $S_{53}$. The high level signal of discrimination circuit 75 is supplied to one of the inputs of AND circuit 81. The high level milling drive signal $S_{63}$ is further supplied to the other input of AND circuit 81, so the high level output signal of discrimination circuit 75 is supplied to the gate of transfer gate circuit 89 through AND circuit 81 and OR circuit 85. The count value during the latter 0.5 second of each count value of the count signal $S_{53}$ stored in display memory 91 is therefore fed to display unit 37. Display unit 37 shows the flashing display with a period of 1 second, illuminated for 0.5 second and extinguished for 0.5 second. Thus, the individual number of the count values such as, i.e., 12, 11, 10, . . . , 0 is successively displayed for 0.5 second indicating the amount of remaining milling time.

After the display operation, when the count value of load counter 53 goes to 0, the output signal of the not-zero output NZ is inverted into a low level, AND circuit 63 ceases to output a high level milling drive signal $S_{63}$, so milling drive circuit 65 opens first switch 5 to stop the milling operation. When, subsequently, the signal of the not-zero output NZ of load counter 53 goes to 0, the output signal of inverter circuit 69 becomes high, so AND circuit 67 outputs a high level drip drive signal $S_{67}$. Drip drive circuit 71 closes second switch 11 to energize heater 7, so that it starts to supply hot water into the milling container and thus starts the extraction of the coffee liquid. At this time, when AND circuit 63 ceases to output milling drive signal $S_{63}$, the output signal of AND circuit 99 becomes low. Thus, transfer gate circuit 95 disables load counter 53 from feeding the count signal $S_{53}$ to display memory 91. Also, since the output signal from AND circuit 99 is low and milling-time-setting signal $S_{29}$ is not being output, the output signal of NOR circuit 105 becomes high, so that the count signal $S_{41}$ of clock counter 41 is now supplied to display memory 91 through transfer gate circuit 97. Furthermore, the high level drip drive signal $S_{67}$ from AND circuit 67 is also supplied to the gate of transfer gate circuit 77 to enable transfer gate circuit 77 to supply the count signal $S_{23}$ of one-minute counter 23 to the input of discrimination circuit 75. As a result, the output signal of discrimination circuit 75 is a high level when the count value of the 1/10 second unit in the count signal $S_{23}$ is 0 to 4, and is low level when it is 5 to 9. This output signal is supplied to one of the inputs of AND circuit 81. At this time, the other input of AND circuit 81 is supplied with the high level drip drive signal $S_{67}$ through OR circuit 83, so the high level output of discrimination circuit 75 is fed to the gate of transfer gate circuit 89 through AND circuit 81 and OR circuit 85. Display unit 37 therefore indicates current time flashing with a period of one second.

It should be noted that during the milling operation or during the drip operation as above-described or when the drip operation is completed, if the stop signal $S_{33}$ is produced by pressing stop key 33 for a short time, flip-flop circuit 57 is reset so that the output Q becomes low. Subsequently, each one of the inputs of AND circuits 63 and 67 becomes low level to stop the output of milling drive signal $S_{63}$ and drip drive signal $S_{67}$.

In a milling operation, as described above, transfer gate circuit 89 turns ON and OFF with a period of one second in accordance with the count value of load counter 53 to make the display of the display unit flash. Consequently, in a conventional timer apparatus, if milling-time-setting key 29 is pressed in order to change the setting value of load counter 53, for example during a milling operation, even though the count signal $S_{49}$ of milling-time-setting counter 49 is supplied to display memory 91 through transfer gate circuit 93 and the setting value is indicated by display unit 37, the indicated setting value is also flashed.

According to the present embodiment, when milling-time-setting key 29 is pressed, the high level milling-time-setting signal $S_{29}$ is fed to the gate of transfer gate circuit 89 through OR circuits 87 and 85 so that transfer gate circuit 89 is continuously ON instead of being turned ON and OFF by the output signal of discrimination circuit 75. The indication of the setting value from milling-time-setting counter 49 by display unit 37 is therefore changed over the continuous display.

During drip operation, as described above, transfer gate circuit 89 turns ON and OFF with a period of one second in accordance with the count value of one-minute counter 23 to flash the display of display unit 37. In the conventional timer apparatus, even though clock setting key 27 is pressed in order to change the count value of the clock counter 41, the indication by the display unit is also flashed. According to the present embodiment, however, when clock-setting key 27 is pressed, the high level clock setting signal $S_{27}$ is fed to the gate of transfer gate circuit 89 through OR circuits 87 and 85. The display of display unit 37 is therefore changed over to a continuous display.

In summary, with this embodiment, when milling-time-setting key 29 or clock-setting key 27 is pressed during the milling operation or drip operation, the display of display unit 37 is changed from a flashing display to a continuous display. Accordingly, when altering a set value of load counter 53 or a count value of clock counter 41, the setting operation is facilitated and the desired set value may be set accurately. Although in the above-described embodiment an OR circuit 87 was provided as the changeover means, it would be possible to make the output of discrimination circuit 75 continuously a high level, to achieve the same result, by feeding clock setting signal $S_{27}$ or milling-time-setting signal $S_{29}$ to the discrimination circuit 75. Also, the display of the display unit was made to flash with a period of one second, but this flashing period could be set to any desired value.

Further, in the above-described embodiment, although the display of the display unit is changed from the flashing state (a first state) to the continuous state (a second state) when the milling-time-setting key or clock-setting key is pressed, it would be possible to make the second state include the ON period of time of the display longer than that of the first state or the OFF period of time of the display shorter than that of the first state.

Furthermore, in this embodiment, this invention was applied to a coffee maker, but the present invention could be applied to not only coffee makers but also any electrical apparatus which is equipped with a counter having a clock function or a load controlling function and wherein the count value of the counter is displayed in flashing state while the load is being driven.

Many changes and modifications in the above-described embodiment can be carried out without departing from the scope of the present invention. Therefore, the claims should be construed to include such modifications.

What is claimed is:

1. A timer device for controlling a load comprising:
- means for counting at a predetermined rate;
- means for selectively operating said load;
- means for setting a set value for said counting means;
- means for displaying a count value of said counting means when said setting means is not operated and for displaying said set value when said setting means is operated; and
- control means for causing said displaying means to display said count value in a first state when said operating means causes said load to be operated and for causing said displaying means to display said set value in a second state when said setting means is operated while said operating means causes said load to be operated.

2. A timer device according to claim 1, wherein said setting means includes load operation time setting counter means for storing said set value.

3. A timer device according to claim 2, wherein said display means includes a display memory for storing said set value or said count value to be displayed.

4. A timer device according to claim 1, wherein said first state is a flashing display state.

5. A timer device according to claim 4, wherein said second state is a continuous display state.

6. A method of displaying times associated with a timer device controlling a load comprising the steps of:
- counting operation time that said load is being operated;
- displaying said operation time in a first state while said load is being operated;
- entering a set time that said load is to be operated; and
- displaying said set time during said entering step in a second state even if said load is being operated.

7. A method of displaying times associated with a timer device controlling a load, comprising the steps of:
- producing a load operation time setting signal with setting means;
- generating a set count signal with a load operation time setting counter means in response to said load operation time setting signal;
- applying said set count signal to counter means and display means from the load operation time setting counter means;
- operating said load for a time indicated by said counter means;
- transferring said load operation time setting signal to control means;

displaying, in response to said control means, a count of said counter means in a first state when said load is operating; and displaying, in response to said control means, a set count signal in a second state when said load operation time setting signal is applied to said control means even if said load is operating.

8. A method as in claim 7 wherein said first state displaying step is flashing.

9. A method as in claim 8 wherein said second state displaying step is on continuously.

* * * * *